US005718255A

United States Patent [19]

Gilpatrick et al.

[11] Patent Number: 5,718,255

[45] Date of Patent: Feb. 17, 1998

[54] FLOW-RESPONSIVE DIVERTING VALVE

[75] Inventors: Richard J. Gilpatrick, Whitewater; Wes Sodemann, Dousman, both of Wis.

[73] Assignee: Generac Corporation, Waukesha, Wis.

[21] Appl. No.: 780,810

[22] Filed: Jan. 9, 1997

[51] Int. Cl.[6] ..... G05D 11/00

[52] U.S. Cl. ..... 137/10; 137/115.06; 137/115.17; 137/115.11; 137/115.16; 137/529; 137/115.05; 137/533.11; 251/65; 417/299

[58] Field of Search ..... 137/115.06, 460, 137/115.05, 115.03, 115.17, 529, 560, 517, 533.11, 519.5; 251/65; 417/307, 309, 299

[56] References Cited

U.S. PATENT DOCUMENTS

| | | | |
|---|---|---|---|
| 2,746,250 | 5/1956 | Hawkins | 137/115.11 |
| 3,064,684 | 11/1962 | Hutton | 137/625.4 |
| 3,200,214 | 8/1965 | Aubert | 200/81.9 |
| 3,211,173 | 10/1965 | Mueller et al. | 137/454.5 |
| 3,279,487 | 10/1966 | Elam | 137/63 |
| 3,522,999 | 8/1970 | Liles | 417/282 |
| 3,889,709 | 6/1975 | Dwyer | 137/504 |
| 3,921,662 | 11/1975 | Hauffe | 137/517 |
| 4,182,354 | 1/1980 | Bergstedt | 137/115.03 |
| 4,249,558 | 2/1981 | Clifford | 417/299 |
| 4,278,102 | 7/1981 | Kelley | 137/460 |
| 4,519,792 | 5/1985 | Dawe | 604/152 |
| 4,637,427 | 1/1987 | Nolan et al. | 137/460 |
| 4,960,146 | 10/1990 | Morris | 137/460 |
| 5,007,391 | 4/1991 | Nomoto | 417/299 |
| 5,409,032 | 4/1995 | Berfield | 417/299 |

*Primary Examiner*—Denise L. Ferensic
*Assistant Examiner*—Ramyar Farid
*Attorney, Agent, or Firm*—Jansson, Shupe, Bridge & Munger, Ltd.

[57] ABSTRACT

A flow-responsive diverting valve is particularly useful with pressure washers of the type having a water pump coupled to an internal combustion engine equipped with a pull-rope starter. The valve provides an "easy-start" feature and has a valving chamber and a fluid inlet and two fluid outlets. A magnet is fixed on the valve body and when fluid flows into the inlet at the low flow rate occurring when operating the starter, a valving device, e.g., a check ball, is restrained by the magnet. When fluid flows into the inlet at a higher flow rate (as when the engine is running and the pump is delivering water at a substantial rate), the device closes the first outlet and diverts water to the second outlet. A method for operating a pressure washer includes magnetically restraining the valving device away from the first outlet while operating the starter and then running the engine, thereby urging the device to close the first outlet.

14 Claims, 3 Drawing Sheets

FIG. 4
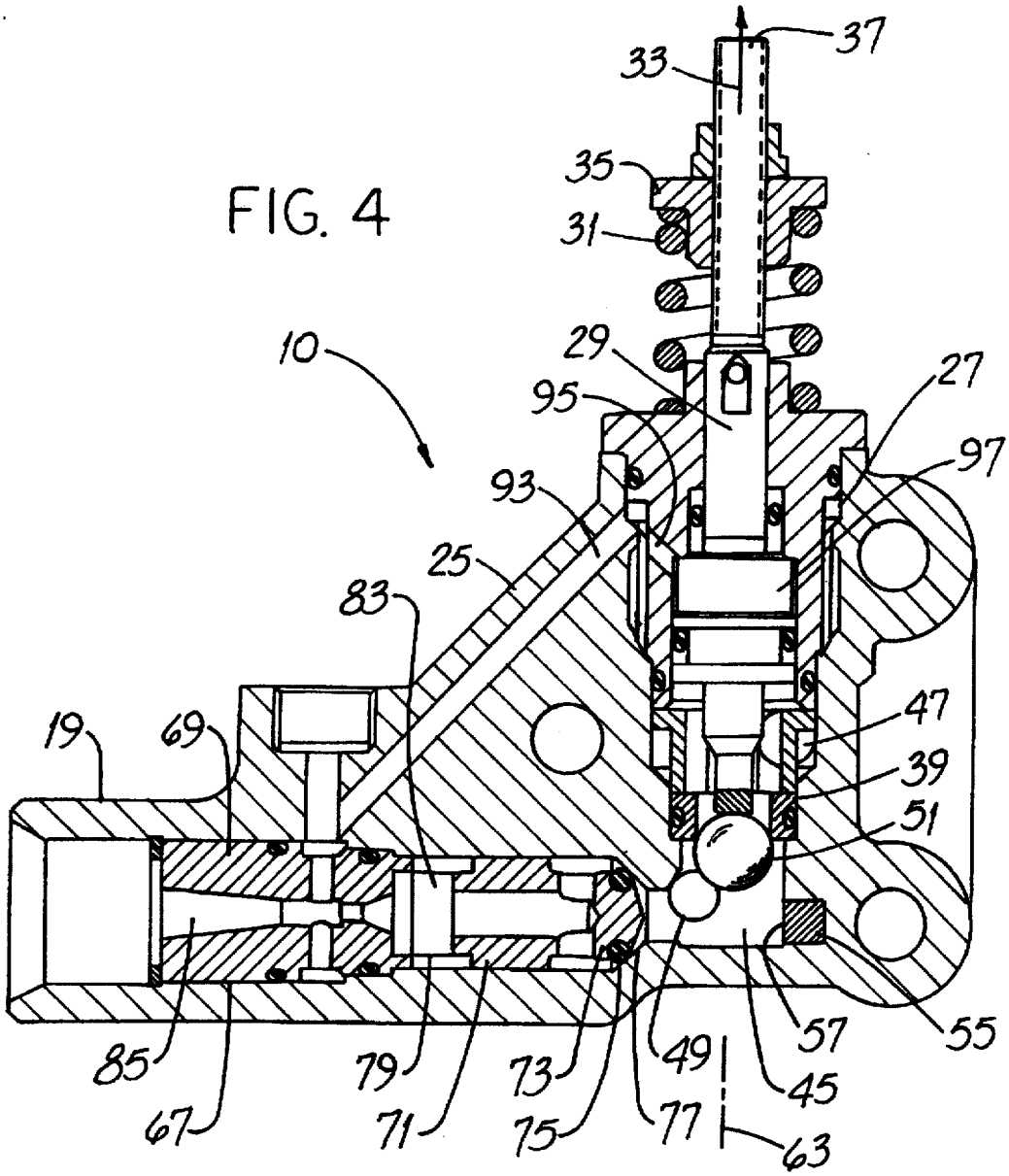
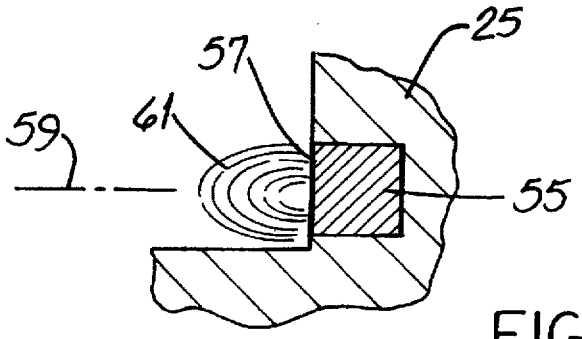
FIG. 6

FLOW-RESPONSIVE DIVERTING VALVE

FIELD OF THE INVENTION

This invention relates generally to pumps and, more particularly, to pumps having a normally-open bypass closed by increased flow.

BACKGROUND OF THE INVENTION

Motive power for pumps is often provided by an internal combustion engine. Larger engines are equipped with a solenoid-type electric starting motor and small engines of a few horsepower or so are often equipped with a pull-rope starter.

The output horsepower available from the starting motor or from a person operating a pull-rope starter is quite low. At least for that reason, pump manufacturers have long recognized the desirability of "unloading" the pump during starting. When a pump is unloaded, the starting apparatus (whether electric or human-powered) need not work against the pump pressure head. Rather, the pressure at the pump outlet is held to a relatively-low value until the engine starts.

U.S. Pat. No. 3,522,999 (Liles) and U.S. Pat. No. 3,889,709 (Dwyer) disclose spring-biased valves which unload an engine-driven pump during engine startup. The valves close under the influence of higher flow rates resulting from increasing engine speed.

One type of apparatus having a pump driven by a prime mover is known as a pressure washer. Pressure washers find wide use in, for example, wall and truck body "wash down" and even in removing paint from surfaces.

Some configurations of water-spraying pressure washers use a pump driven by a gas engine equipped with a pull-rope starter. To help avoid trying to start the engine against a pump pressure head, pumps are equipped with an unloading valve, the ball component of which "free floats" in the valve. But even during pull-rope engine starting, the pump may produce enough output flow and resulting turbulence and pressure to urge the ball against the seat and close the vent.

U.S. Pat. No. 3,200,214 (Aubert) discloses embodiments of flow control devices having an inlet, an outlet and a magnet to hold a ball in a position. If flow exceeds a predetermined level, the ball is urged away from the magnet and against the outlet, totally closing it.

U.S. Pat. No. 4,637,427 (Nolan et al.) discloses a valve, the operation of which is closely similar to that of the flow control devices of the Aubert patent. That is, a valve is held away from its seat at flow rates below some predetermined value and fluid is permitted to flow from inlet to outlet. At flow rates in excess of such value, the valve closes against the seat and shuts off flow. The Liles, Dwyer, Aubert and Nolan et al. patents do not allude to the possibility of using the disclosed apparatus in those special applications involving pressure washer pumps.

A flow-responsive diverting valve which is particularly configured for use with pressure washers, which is readily adapted to existing pressure washers and which helps assure that the pressure washer pump remains unloaded during even vigorous pull-rope starting would be a significant advance in the art.

OBJECTS OF THE INVENTION

It is an object of the invention to provide a flow-responsive diverting valve which is particularly configured for pressure washers.

Another object of the invention is to provide a flow-responsive diverting valve which is readily adapted to existing pressure washers.

Another object of the invention is to provide a flow-responsive diverting valve which is effective for pump unloading even during slightly-elevated pressure and turbulent flow that often accompanies pull-rope starting.

Yet another object of the invention is to provide a flow-responsive diverting valve which permits flow through one flow outlet during pressure washer starting and diverts flow through another outlet while the pressure washer is running.

Another object of the invention is to provide a new method for placing a pressure washer into operation.

Still another object of the invention is to provide a new method involving shutting down a pressure washer. How these and other objects are accomplished will become apparent from the following descriptions and from the drawings.

SUMMARY OF THE INVENTION

The new flow-responsive diverting valve is particularly useful with a pump driven by an internal combustion engine having a pull-rope starter. The valve includes a valve body having a valving chamber, a fluid inlet and first and second fluid outlets formed in the body to be in flow communication with the chamber. The second outlet has a greater resistance to fluid flow than the first outlet.

A magnet is fixed with respect to the body and a valving device such as a check ball is in the chamber. When fluid flows into the inlet at a first flow rate such as that occurring when the engine is being started, the device is restrained by the magnet and is spaced from the outlets. And when fluid flows into the inlet at a second, higher flow rate such as that occurring when the engine is running, the device closes the first outlet and diverts fluid to the second outlet and thence to the nozzle from which the liquid delivered by the pump is expelled.

As to flow rates, the first flow rate is typically in the range of 15% to 25% of the second flow rate. In the combination of a water pump and accompanying engine configured as a pressure washer, an exemplary first flow rate during pull-rope engine starting may be 1 to 1.5 gpm and an exemplary second flow rate with engine running may be 5 to 6 gpm. But the ratio of flow rates and the specific values of flow rates may vary widely without departing from the invention.

In a highly preferred embodiment, the magnet extends along a first axis and exhibits a magnetic field along same axis. The valving device moves along a second axis angled with respect to the first axis and, most preferably, generally perpendicular to the first axis.

A new method for operating a pressure washer includes providing a valve coupled to the pump and having the above-noted valve chamber, valving device, fluid inlet and first and second fluid outlets. The valving device is magnetically restrained away from the first outlet while operating the starter. Upon running the engine, the device is urged (by forces resulting from substantially-increased flow) to a position to close the first outlet.

In a more specific aspect, the magnetically restraining step includes flowing water into the inlet at a first flow rate and also includes holding the device away from the second outlet. The running step includes flowing water from the pump into the inlet at a second flow rate greater than the first flow rate.

The new method also includes steps relating to that aspect of operating a pressure washer which involves shutting it down. The method includes the steps of stopping the engine and urging the device away from the first outlet. In a more specific aspect of the method, the valve includes a feedback cavity and a plunger interposed between the first outlet and the feedback cavity. The urging step includes pressurizing the feedback cavity and also includes moving the plunger toward the first outlet. (As used herein, "operating a pressure washer" contemplates starting the washer, running it or shutting it down.)

Other details of the invention are set forth in the following detailed description and in the drawings.

BRIEF DESCRIPTION OF THE DRAWINGS

FIG. 4 is a section view of the new flow-responsive diverter valve with its check ball in the position assumed by such ball when the engine is running. Certain parts are shown in full representation.

FIG. 6 is an enlarged section view of a portion of the valve of FIGS. 4 and 5. Parts are broken away.

DETAILED DESCRIPTIONS OF PREFERRED EMBODIMENTS

Figure 1:
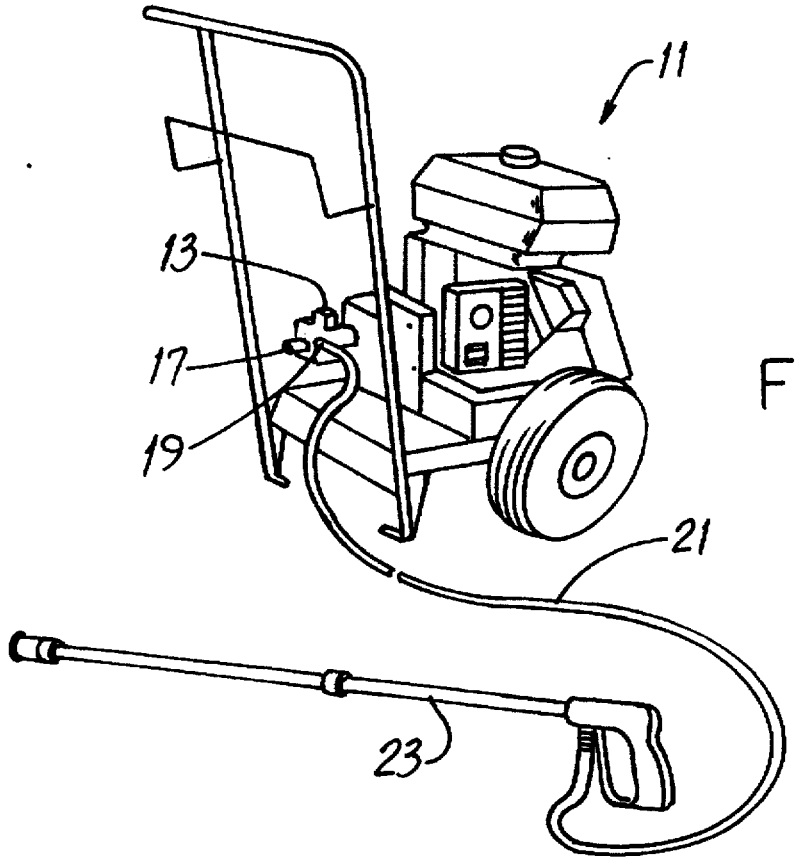
FIG. 1 is a perspective view of an exemplary pressure washer. Parts are broken away.
Figure 3:
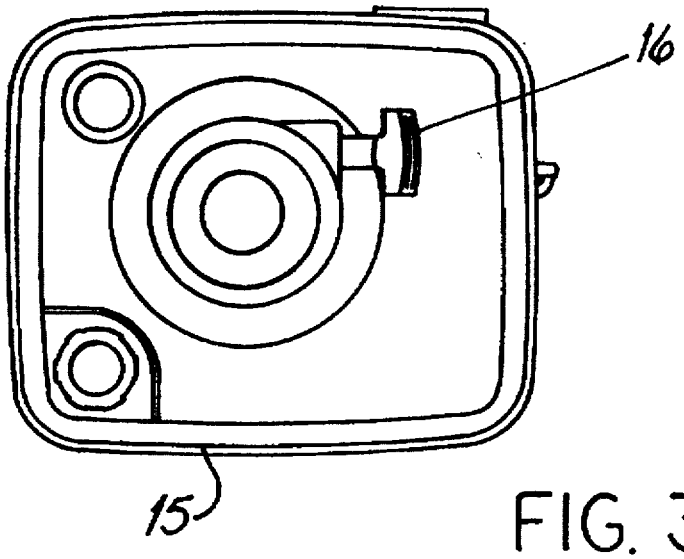
FIG. 3 is a top plan view of the engine taken along the viewing axis VA3 of FIG. 2.
Figure 2:
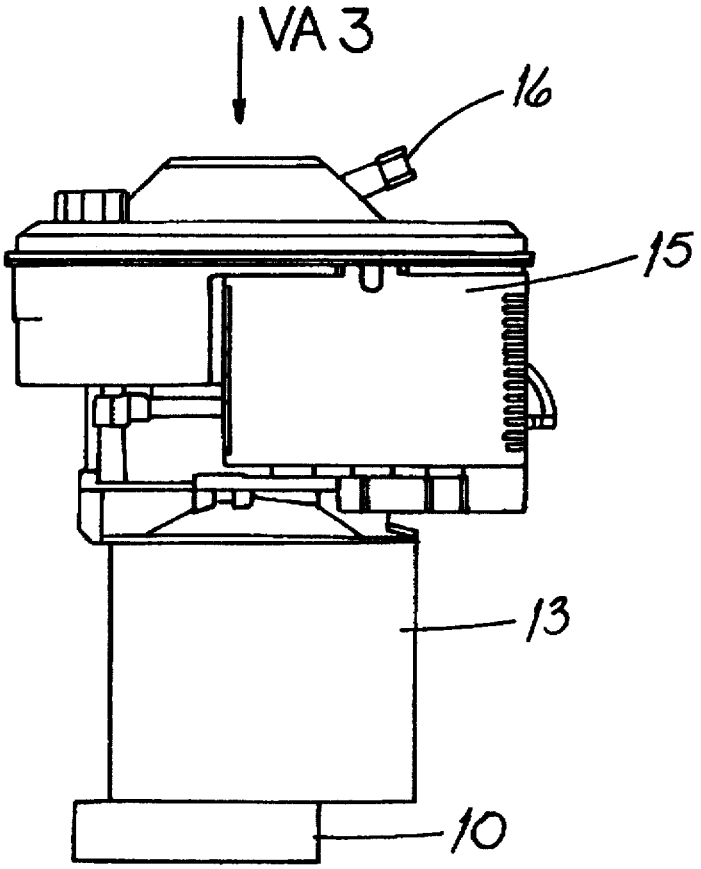
FIG. 2 is a representative side elevation view of a pump mounted on an internal combustion engine driving the pump.

Referring to FIGS. 1–3, after appreciating the following description, it will be clear that the new flow-responsive diverting valve 10 (sometimes referred to as an "easy-start" unloading valve) may find general application with engine-driven pumps. However, such valve 10 is particularly useful with a pressure washer 11 having a pump 13 driven by an internal combustion engine 15 equipped with a pull-rope starter 16. Therefore, an understanding of some aspects of a pressure washer 11 will be helpful in understanding the valve 10 and related method.

The pressure washer 11 includes a prime mover embodied as an internal combustion engine 15 to which is coupled a high-pressure water pump 13. The pump 13 has an inlet 17 to which a source of water, e.g., a garden hose, is attached and water at high pressure is discharged from the outlet port 19 to a hose 21 connected to a hand-manipulated spray wand 23. The engine 15 is equipped with a pull-rope starter 16. The flow-responsive diverting valve 10 is coupled to the pump 13 and, most preferably, is configured as an integral part of such pump as represented in FIG. 2.

Figure 5:
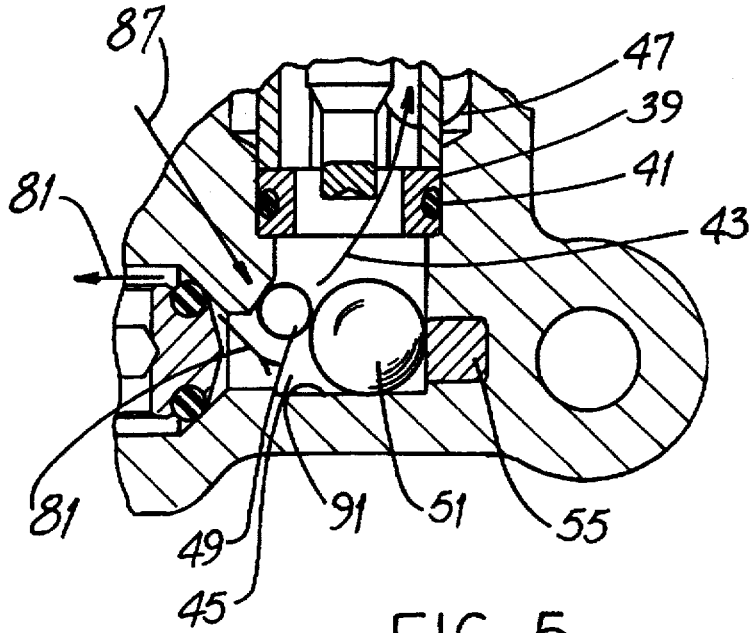
FIG. 5 is a section view of a portion of the valve of FIG. 4 with its check ball in the position assumed by such ball when the engine is being started. Parts are broken away and certain other parts are shown in full representation.

Referring next to FIGS. 4 and 5, the valve 10 includes a valve body 25 with a bore 27 containing a plunger 29 biased by the compression spring 31 in the direction indicated by the arrow 33. The nut 35 is rotated on the plunger rod 37 to set the maximum pump pressure.

The valve 10 also has an annular seat 39 fixed in the body 25 and sealed thereagainst by an O-ring 41. As represented by the arrow 43, a first outlet 43 leads from the valving chamber 45 through the seat 39 to a flow port 47 in communication with the pump inlet 17. Thus, water flowing through the outlet 43 is "recycled" back to the pump 13.

When rotating (whether driven by force applied to the pull-rope starter 16 or by the engine 15 when running), the pump 13 delivers water into the valving chamber 45 through the inlet opening 49. A valving device, preferably embodied as a check ball 51, is captured in the chamber 45 and when the ball is in the position shown in FIG. 4, i.e., against the seat 39, the first outlet 43 is closed.

Referring also to FIG. 6, the valve 10 has a generally cylindrical magnet 55 fixed in the body 25 and preferably cast as an integral part of such body 25. The magnet face 57 is exposed in the chamber 45. As represented by FIG. 6, the magnet 55 extends along a first or magnet axis 59 and the "standing" magnetic field 61 produced by the magnet 55 extends along the same axis 59. And as shown in FIG. 4, the ball 51 moves along a second axis 63 which angled with respect to the first axis 59 and, most preferably, which is perpendicular to the first axis 59.

Referring further to FIG. 4 and also to FIG. 1, the valve body 25 also has a bore 67 containing a positionally-fixed venturi ejector 69 and a piston 71 mounted for sliding movement in the bore 67. The piston 71 has a dome-like head 73 with a sealing ring 75 thereon. In the absence of flow forces urging the head 73 away from its seat 77, the spring 79 biases the piston 71 to a position sealing the second outlet as represented by the arrow 81 in FIG. 5. And when the head 73 is away from its seat 77, water entering the inlet 49 may flow through the second outlet 81 i.e., around the head 73, through the passages 83, through the ejector passage 85 and through the hose 21 to the wand 23. From the foregoing, it is apparent that when the head 73 is against the seat 77 and the ball 51 is away from the seat 39, the second outlet 81 has a substantially greater resistance to fluid flow than the first outlet 43.

Referring to the FIGURES, in operation, the assumed initial condition is that the engine 15 is off and that the ball 51 is restrained by the magnet 55 as shown in FIG. 5. When considering FIG. 5, it is to be appreciated that the inlet 49 (and the passage leading to the inlet 49) delivers water to the chamber 45 in a direction indicated by the arrow 87. That is, water is "aimed" in the direction of the region between the ball 51 and the chamber wall 91.

When the pull-rope starter 16 is operated, the pump 13 rotates at a modest speed, e.g., 350 rpm or so, and pumps water to the inlet 49 at a first, comparatively-low flow rate. At such flow rate, the magnet 55 is capable of and does restrain the ball 51 in the position shown in FIG. 5, notwithstanding some degree of turbulence and pressure rise in the chamber 45. Since the ball 51 is held away from the first outlet 43 (as well as from the second outlet 81), water flows through the first outlet 43 and the second outlet 81 remains closed by the piston 71.

It is now assumed that the engine 15 starts and runs at normal speed, typically well in excess of 2000 rpm. Therefore, the pump 13 also rotates at normal speed and pumps water to the inlet 49 at a second, substantially-higher flow rate.

At such higher flow rate, the magnet 55 is incapable of further restraining the ball 51. In other words, water flow forces "drive" the ball 51 away from the magnet 55 and toward and against the seat 39, thereby closing the first outlet 43. Since the pump 13 continues to deliver water to the inlet 49, pressure in the chamber 45 immediately rises to a level sufficient to compress the spring 79. Thereupon, water flows through the second outlet 81 and thence to the wand 23 as described above.

As another operating condition, it is now assumed that the operator no longer needs use of the pressure washer 11 and shuts it down by stopping the engine 15. When the engine 15 is stopped, the pump 13 no longer delivers high pressure water to the inlet 49. But the hose 21 and outlet port 19 are at relatively-high pressure. In consequence, a pressure "spike" is communicated along the passage 93 and the passage 95 to the feedback cavity 97 at the back side of the plunger 29. Such plunger 29 is thereby "pulsed" in a downwardly direction (as viewed in FIG. 4) toward the seat 39 and bumps the ball 51 away from the seat 39 toward the magnet 55. Thereupon, the magnet 55 "recaptures" the ball 51 in preparation for the next operating cycle. (The action of the plunger 29 against the ball 51 is not unlike that of a pool cue hitting a ball.)

While the principles of the invention have been shown and described in connection with specific embodiments, it is to be understood clearly that such embodiments are by way of example and are not limiting.

What is claimed:

1. A portable pressure washer including an engine-driven pump having a spray wand and a flow-responsive diverting valve coupled thererto, and wherein the wand may be open for spraying or closed for shutting off flow therethrough, the diverting valve including:

a valve body having a valving chamber;

a fluid inlet and first and second fluid outlets, the inlet and outlets being formed in the body in flow communication with the chamber;

a magnet fixed with respect to the body and providing a magnetic field;

a valving device in the chamber;

a pressure-actuated mechanism movable with respect to the first outlet; and a passage in flow communication with the second outlet and the pressure-actuated mechanism; and wherein:

when fluid flows from the pump into the inlet at a first flow rate during engine startup, the device is restrained by the magnet, the first outlet is open and the second outlet is closed by a piston against a seat;

when the engine runs and the wand is open, fluid flows from the pump into the inlet at a second flow rate higher than the first flow rate, and the device closes the first outlet and diverts fluid through the second outlet, thereby urging the piston away from the seat; and when the wand is closed, pressure in the passage actuates the mechanism and urges the device toward the magnetic field.

2. The pressure washer of claim 1 wherein:

the magnetic field extends along a first axis; and the device moves along a second axis angled with respect to the first axis.

3. The pressure washer of claim 2 wherein the second axis is generally perpendicular to the first axis.

4. The pressure washer of claim 1 wherein the piston is biased toward the seat by a spring, thereby providing a greater resistance to fluid flow through the second outlet than through the first outlet.

5. The pressure washer of claim 1 wherein the first flow rate is in the range of 15% to 25% of the second flow rate.

6. The pressure washer of claim 1 wherein the engine has a pull-rope starter and wherein:

fluid flows into the inlet at the first flow rate when the starter is operated and the pump is operating at a lower speed; and fluid flows into the inlet at the second flow rate when the engine is running and the pump is operating at a higher speed.

7. The pressure washer of claim 6 wherein the piston is biased toward the seat by a spring, thereby providing a greater resistance to fluid flow through the second outlet than through the first outlet.

8. The pressure washer of claim 6 wherein the first flow rate is in the range of 15% to 25% of the second flow rate.

9. A method for operating a portable pressure washer which includes a water pump coupled to an internal combustion engine having a pull-rope starter, and which also includes a spray wand coupled to the pump, and wherein the wand may be open for spraying or closed for shutting off flow therethrough, the method including:

providing a valve coupled to the pump and having (a) a valve chamber, (b) a valving device in the chamber and being made of magnetic material, (c) a fluid inlet and first and second fluid outlets in flow communication with the chamber;

by a magnetic field, magnetically restraining the device away from the first outlet while operating the starter and pumping water into the chamber at a first flow rate;

running the engine, thereby pumping water into the chamber at a second flow rate higher than the first flow rate to urge the device to close the first outlet;

increasing the pressure at the second outlet when the wand is open;

closing the wand; and automatically urging the device toward the magnetic field by utilizing pressure downstream of the second outlet.

10. The method of claim 9 wherein the magnetically restraining step includes holding the device away from the second outlet.

11. The method of claim 9 wherein the first flow rate is in the range of 15% to 25% of the second flow rate.

12. The method of claim 9 wherein the automatically urging step includes:

communicating a pressure spike to a plunger, thereby urging the device away from the first outlet.

13. The method of claim 12 wherein the valve includes a feedback cavity, the plunger is interposed between the first outlet and the feedback cavity and the communicating step includes pressurizing the feedback cavity.

14. The method of claim 13 wherein urging the device away from the first outlet includes moving the plunger toward the first outlet.

* * * * *